US007237586B2

(12) United States Patent
Rankin, Sr.

(10) Patent No.: US 7,237,586 B2
(45) Date of Patent: Jul. 3, 2007

(54) ROTATABLE CUTTING TOOL

(75) Inventor: David Daniel Rankin, Sr., Troutman, NC (US)

(73) Assignee: Moulder Services, Inc., Troutman, NC (US)

( * ) Notice: Subject to any disclaimer, the term of this patent is extended or adjusted under 35 U.S.C. 154(b) by 0 days.

(21) Appl. No.: 11/047,395

(22) Filed: Jan. 31, 2005

(65) Prior Publication Data

US 2005/0127220 A1 Jun. 16, 2005

Related U.S. Application Data

(63) Continuation-in-part of application No. 10/277,766, filed on Oct. 22, 2002, now Pat. No. 6,896,017.

(51) Int. Cl.
*B27C 9/00* (2006.01)
*B27C 1/00* (2006.01)

(52) U.S. Cl. ..... 144/375; 144/363; 144/230

(58) Field of Classification Search ..... 144/172, 144/174, 218, 221, 230, 235, 240, 363, 375; 407/36, 40, 41, 47, 49; 83/698.41, 698.51, 83/698.61
See application file for complete search history.

(56) References Cited

U.S. PATENT DOCUMENTS

| | | | | | |
|---|---|---|---|---|---|
| 537,887 | A | | 4/1895 | Bradley | |
| 838,305 | A | | 12/1906 | Curial | |
| 861,368 | A | * | 7/1907 | Juengst | 407/49 |
| 1,068,361 | A | * | 7/1913 | Olver | 144/218 |
| 1,222,871 | A | * | 4/1917 | Jesseph | 144/222 |
| 1,265,501 | A | * | 5/1918 | Payzant | 144/91.2 |
| 1,532,548 | A | | 4/1925 | Ramsey | |
| 1,762,111 | A | * | 6/1930 | Weddell | 407/38 |
| 2,631,405 | A | | 3/1953 | Masten | |
| 2,701,540 | A | | 2/1955 | Hamilton | |
| 3,430,605 | A | | 3/1969 | Wood | |
| 3,575,128 | A | | 4/1971 | Pool et al. | |
| 3,575,129 | A | | 4/1971 | Sullivan | |
| 3,654,553 | A | | 4/1972 | Mary et al. | |
| 3,752,113 | A | | 8/1973 | Blechman | |
| 3,933,189 | A | * | 1/1976 | Boles et al. | 144/117.1 |
| 4,026,042 | A | | 5/1977 | Ames | |

(Continued)

FOREIGN PATENT DOCUMENTS

| | | | |
|---|---|---|---|
| DE | 3327026 A1 | * | 2/1985 |
| GB | 2087792 | * | 6/1982 |

OTHER PUBLICATIONS

Photograph 1 shows a straight bore cutter head body, date unknown.
Photograph 2 shows a hydro locking cutter head body, date unknown.
Photograph 3 shows a self-centering sleeve cutter head body, date unknown.
U.S. Appl. No. 10/106,595, filed Mar. 26, 2002 entitled *Rotatable Cutting Tool With colored Visual Warning*; Inventor: Rankin, Sr., D.

*Primary Examiner*—Shelley Self
(74) *Attorney, Agent, or Firm*—Alston & Bird LLP

(57) ABSTRACT

There is provided a rotatable cutting tool for supporting at least one knife in at least two alternate angular cutting configurations. The cutting tool includes a body that defines at least one cavity extending generally in a longitudinal direction of the body. Each cavity is configured to support one of the knives at predetermined hook and shear angles, and each cavity can be configured to provide a different hook and/or shear angle.

34 Claims, 7 Drawing Sheets

U.S. PATENT DOCUMENTS 4,099,480 A 7/1978 Loustaunau
4,121,851 A 10/1978 Finkenbiner
4,345,540 A 8/1982 Karmin
4,449,556 A * 5/1984 Colton ..... 144/230
4,830,073 A * 5/1989 De Abreu ..... 144/221
4,869,302 A 9/1989 Robson
5,105,308 A 4/1992 Holley et al.
5,224,830 A 7/1993 Wang
5,239,396 A 8/1993 Thompson
5,240,192 A * 8/1993 Tilby et al. ..... 241/292.1
5,267,817 A 12/1993 Englund
5,658,101 A * 8/1997 Hammer ..... 407/37
6,048,068 A 4/2000 Broten
6,499,917 B1 12/2002 Parker et al.
6,662,694 B2 12/2003 Rankin, Sr.
6,776,203 B1 * 8/2004 Cecchi ..... 144/221

* cited by examiner

ROTATABLE CUTTING TOOL

CROSS-REFERENCE TO RELATED APPLICATION

This application is a continuation-in-part of U.S. application Ser. No. 10/277,766, filed Oct. 22, 2002, now U.S. Pat. No. 6,896,017, which is hereby incorporated herein in its entirety by reference.

BACKGROUND OF THE INVENTION

1) Field of the Invention

The present invention relates to rotatable cutting tools and, more specifically, to supporting one or more knives in alternate configurations.

2) Description of Related Art

Rotatable cutting tools are well known in the art and include, among others, saws, knives, cutterheads, heads or chucks with removable knives, drill bits, router bits, drills, end mills, moulders, and grinders of multiple shapes. These tools are used for cutting or grinding a variety of structural materials including, but not limited to, wood, metal, composite materials, plastic, foam, food products, and the like.

One conventional rotatable cutting tool, commonly referred to as a cutterhead, typically includes a generally cylindrical body that defines several longitudinally extending cavities for receiving knives. Each knife is inserted into one of the cavities and positioned so that a cutting edge of the knife extends from the cutterhead. The knife is then secured in place by tightening bolts that extend through part of the body and urge the knife against one wall of the cavity. Typically, the bolts are inserted through milled pockets on the outside of the cutterhead so that the heads of the bolts do not extend from the tool. The cutterhead is then rotated, for example, by a spindle that is connected to a motor. Structural material is brought into contact with the rotating knives, and the structural material is cut or scraped by the knives.

The configuration of the knives relative to the body affects the type of cutting or scraping that is achieved. For example, the hook and shear angles of the knives can affect the degree of material that is removed by each knife and the surface that is left on the structural material. The hook angle is measured as the angle between a leading surface of the knife and a radial line of the body that extends through the edge of the knife. A positive hook angle indicates that the leading surface of the knife is angled toward the direction in which the knife rotates. A knife with zero or little hook angle contacts the structural material so that the edge of the knife is approximately perpendicular to the surface of the structural material, thus resulting in a primarily scraping action of the structural material. A knife with positive hook angle, however, tends to achieve a slicing action because the cutting edge is directed closer to the direction of motion of the knife relative to the structural material.

The shear angle is measured as the angle between the longitudinal extension of the blade and the longitudinal axis of the body. For example, a zero shear angle indicates that the blade is parallel to the longitudinal axis of the body. A non-zero shear angle indicates that the blade is angled relative to the body so that a first end of the blade leads the blade and the opposite end of the blade trails as the body and blade are rotated.

An improper hook or shear angle can result in fracturing of the wood, rough or uneven work surfaces, excessive wear of the knives, and other poor cutting characteristics. The best hook and shear angle can depend on the structural material, including grain, fracture, and hardness characteristics. Thus, processing different structural materials can require adjustment of the hook and/or shear angle of the knives. For example, it is known in the art to use a hook angle of about 12° when cutting certain hard woods and 20° when cutting certain soft woods. Because the hook and shear angle of the knives is typically determined by the configuration of the cavities of the cutterhead, adjusting the hook or shear angle can require changing the knives and/or cutterhead, which can be time consuming, thereby reducing machine efficiency. Additionally, keeping multiple cutterheads with different hook and shear angles on hand for different processes requires a disadvantageous additional expense.

A known cutterhead includes a first pair of cavities configured at a first hook angle, and a second pair of cavities that are completely separate from the first pair of cavities and configured at a second hook angle. Knives are positioned in either the first or the second pair of cavities, and fillers are typically positioned in the other pair of cavities such that the fillers do not extend from the cavities. Bolts are used to secure the knives and fillers in the respective cavities. When it is desired to adjust the hook angle of the knives, the position of the knives and fillers are reversed. Thus, a single cutterhead provides two modes of operation, each characterized by a distinct hook angle. However, the provision of additional cavities that are not occupied by knives can change the rotational and balance characteristics of the cutterhead and the tool can be damaged if used without securing appropriate fillers in the cavities that are not being used to secure knives. If fillers are positioned in the unused cavities, there is a risk that improperly sized or weighted fillers will be used, thereby increasing the risk of tool failure and damage to nearby equipment. Additionally, the milled pockets provided for the bolts can also adversely affect the strength of the tool as well as the rotational and weight characteristics of the tool. Further, if the bolts are not properly tightened, the knives and/or fillers may become loose during operation and be projected from the tool.

Thus, there exists a need for an improved rotatable cutting tool that can support one or more knives in alternate angular configurations to achieve multiple hook angles at one or more shear angles. Preferably, the cutting tool should reduce the likelihood of incorrect installation of knives, fillers, bolts, and/or other components. Additionally, the cutting tool should be compatible with different knives and adaptable to conventional tool variations.

BRIEF SUMMARY OF THE INVENTION

In accordance with one aspect, the present invention provides an improved rotatable cutting tool, which is preferably a cutterhead, for supporting at least one cutting instrument such as a knife in at least two alternate angular cutting configurations. The body of the cutting tool defines at least one cavity that preferably extends at least generally in a longitudinal direction of the body, for example, parallel to a longitudinal axis of the body or at an angle to the longitudinal axis of the body. Thus, each cavity can define a hook angle and a shear angle, and different cavities of the body can define different hook and/or shear angles.

According to one embodiment of the present invention, each cavity is preferably defined by first and second knife support surfaces that are in an opposing, face-to-face, non-parallel configuration. The knife support surfaces preferably extend divergingly inwardly from an exterior surface of the body. The first knife support surface is configured to support one of the knives at a first hook angle. The second knife support surface is configured to subsequently support one of the knives at a second, different hook angle. In one example, the first hook angle can be about 12 degrees and the second hook angle can be about 20 degrees. Each angle is measured relative to a radial direction of the body that extends through an edge of the knife supported by the respective knife support surface.

In one embodiment, each cavity is configured to alternately receive a knife against each knife support surface, a filler against the knife support surface that is not occupied by the knife, and a gib between the knife and filler such that the gib urges the knife and filler against the support surfaces and frictionally secures the knife in the cavity. Preferably, at least one of the knife, filler, and gib are slid into the cavity to achieve a frictional press-fit, such as between the gib and the knife and between the gib and the filler. In accordance with one aspect of the present invention, the gib can receive bolts that extend therethrough and, when tightened against a wall that defines the cavity, adjust the gib radially outward to secure the knife and filler. The body can optionally include one or more visual references for indicating a maximum extension position of each knife, the hook angles, or a rotational motion of the cutting tool.

According to another embodiment of the present invention, the rotating cutting tool includes first and second cavities that define different shear angles so that a knife can be selectively supported in the cavities at the different shear angles. For example, each cavity can have a shear angle that is between about 0 and 10 degrees relative to the longitudinal axis of the body. In particular, the first cavity can have a shear angle of about 5 degrees and a hook angle between about 10 and 12 degrees, and the second cavity can have shear angle that is about 10 degrees and a hook angle that is about 20 degrees. The body can define additional cavities that correspond to the first and second cavities so that multiple knives can be supported in each configuration.

The present invention also provides methods of cutting structural material, which in one example includes configuring the cutting tool as described above, mounting the cutting tool body on a rotatable spindle in rotational communication with a rotational actuator, and rotating the cutting tool. The rotational axis and the longitudinal axis of the cutting tool are preferably aligned with one another. Structural material is engaged against the knives and cut. In one embodiment, after cutting, the position of the knife in each cavity is switched with the filler in the respective cavity so that the knife extends from the body at a second angle different from the first angle. Alternatively, the configuration of the knife in each cavity can be otherwise adjusted, e.g., by removing each knife from one cavity and disposing the knife in a different cavity with a different hook and/or shear angle. The cutting tool is then rotated, and the structural material is cut.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 2:
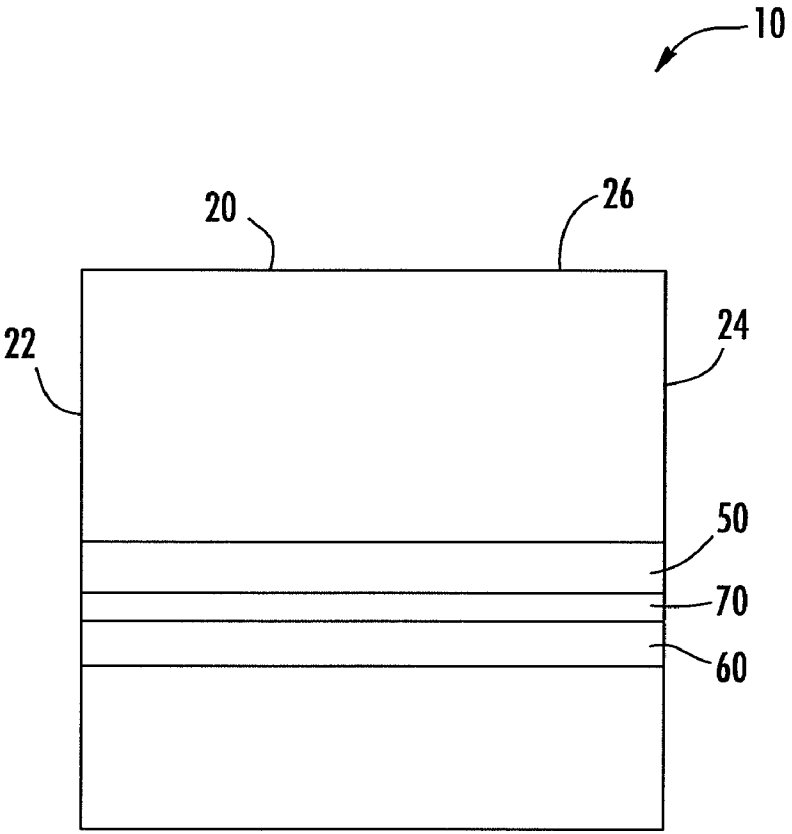
FIG. 2 is a side view of the right side of the cutting tool of FIG. 1.
Figure 1:
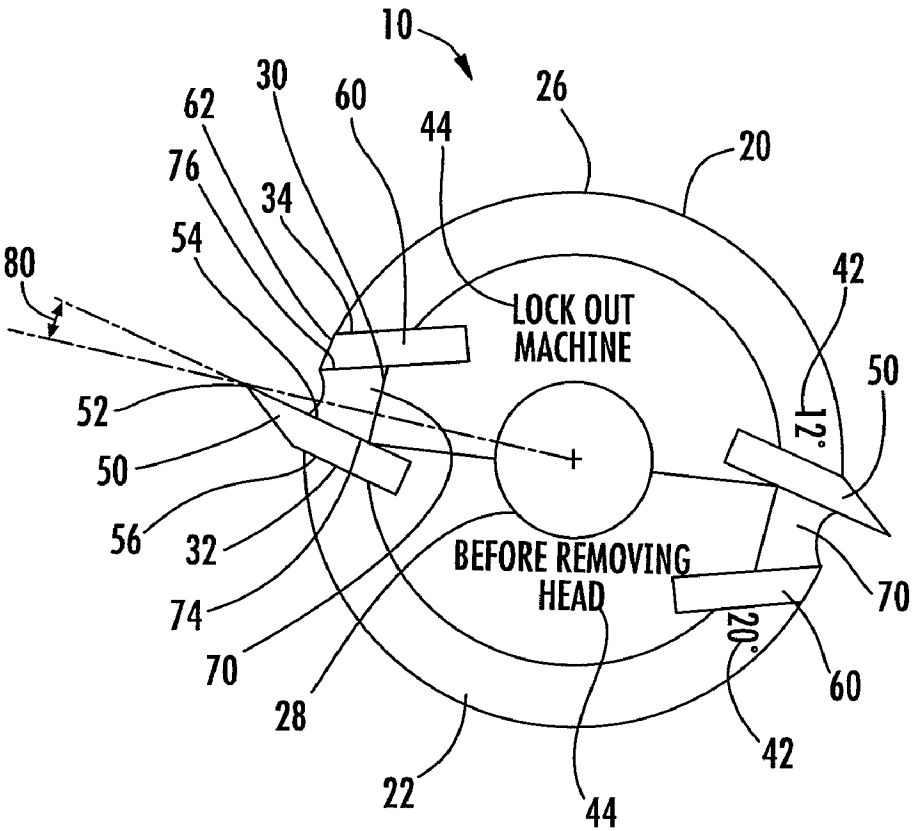
FIG. 1 is an elevation view of a cutting tool according to the present invention with the knives positioned in a first configuration.
Figure 3:
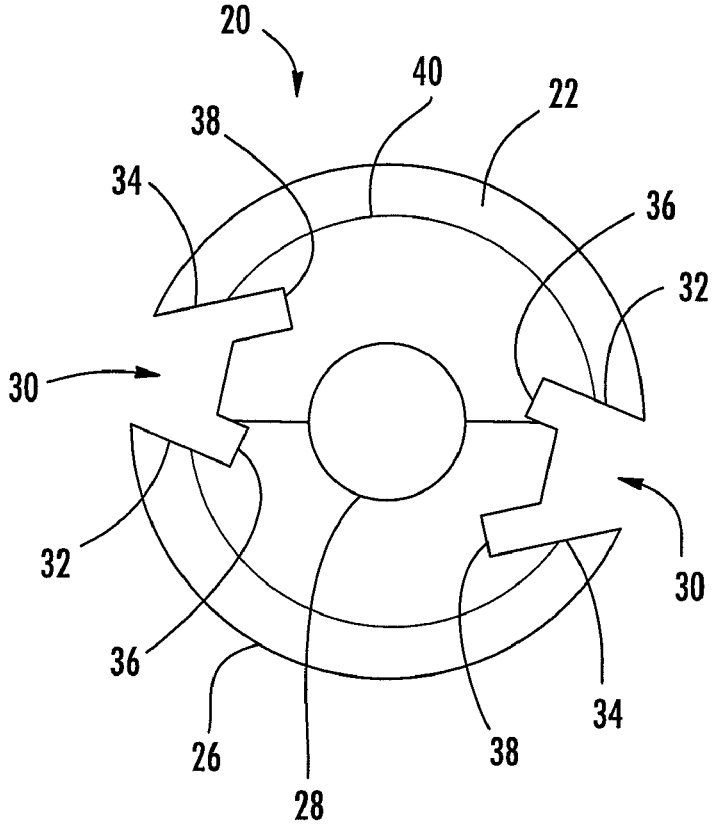
FIG. 3 is an elevation view of the body of the cutting tool of FIG. 1, shown without the visual references for clarity.

FIGS. 1 and 2 diagrammatically illustrate a cutting tool 10 according to one embodiment of the present invention. The cutting tool 10 is preferably a cutterhead that includes a body 20, which defines at least one cavity 30 (FIG. 3). Preferably there are multiple cavities 30 that are each at least generally uniform in shape along the length of the tool 10 and open at the circumferential surface and opposite ends of the tool 10. Knives 50, or other cutting instruments, and fillers 60 can be frictionally secured in the cavities 30 using gibs 70, as described further below. Edges 52 of the knives 50 extend from the body 20 so that a structural material (not shown) such as wood can be brought into contact with the knives 50 as the cutting tool 10 is rotated, and the structural material is thereby cut, scraped, or otherwise processed by the knives 50. Alternatively, rather than using a separate filler 60 and gib 70 in each cavity 30, the filler 60 and gib 70 can be "inseparable parts" of a single holder that is used to secure a knife 50 in a cavity 30.

Figure 2A:
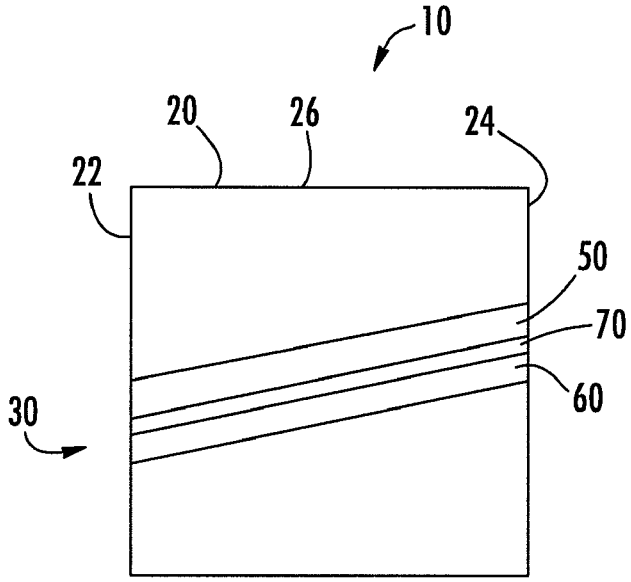
FIG. 2A is a side view of a cutting tool having cavities extending generally in the longitudinal direction, according to another embodiment of the present invention.

The cavities 30 (FIG. 3) can extend in a direction parallel to a longitudinal axis of the body 20, as shown in FIG. 2. Alternatively, the cavities 30 can extend generally in the longitudinal direction of the body 20, for example as shown in FIG. 2A. As illustrated in FIG. 2A, the cavity 30 is arranged to provide a shear angle which is for reducing finish problems when cutting certain types of wood.

As diagrammatically illustrated in FIG. 2, the body 20 defines a first side 22, a second side 24 opposite the first side 22, and an outer surface 26 extending between the first and second sides 22, 24. In the illustrated embodiment, the outer surface 26 is generally cylindrical in shape, but the body 20 can alternatively define a cross section of another shape. The body 20, illustrated independently in FIG. 3, can be formed of a variety of structural materials such as steel or any other suitable material. The body 20 can be formed of a single part or from two or more parts. The illustrated embodiment is formed of two similar parts, which are connected by welding, bolting, riveting, or otherwise fastening. As illustrated in FIG. 3, for each cavity 30, its knife support surfaces 32, 34 are in opposing face-to-face relation.

Figure 5:
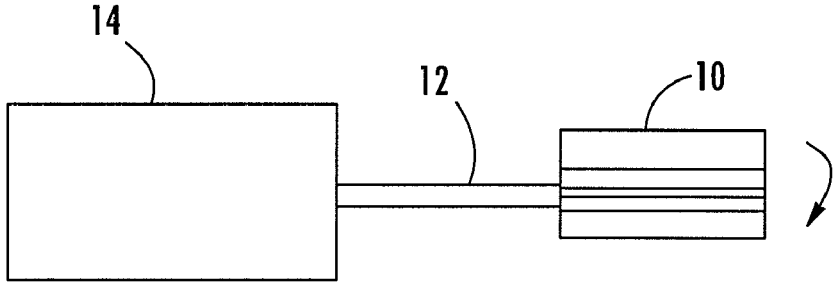
FIG. 5 is an assembly drawing of a cutting machine according to the present invention, including the cutting tool of FIG. 1.

The body 20 also defines a hole 28, which preferably extends completely through the body 20 and is configured to connect to a spindle 12, as shown in FIG. 5, so that the cutting tool 10 can be rotated by the spindle 12. The hole 28 can define a variety of shapes and sizes. For example, in one embodiment, the body 20 has a diameter of about 5.4 inches and the hole 28 is circular with a diameter of about 1.8 inches. The hole 28 can also include a hydro-locking mechanism or a self-centering sleeve, both of which are known per se in the art. The body 20 can be connected to the spindle 12 using a key, slot, press fit, or other known connection methods. The spindle 12 in turn can be connected to and rotated by a rotational actuator 14, such as an electric motor or any other suitable actuator. Preferably the hole 28 is coaxial with the rotational axis of the tool 10.

Figure 4:
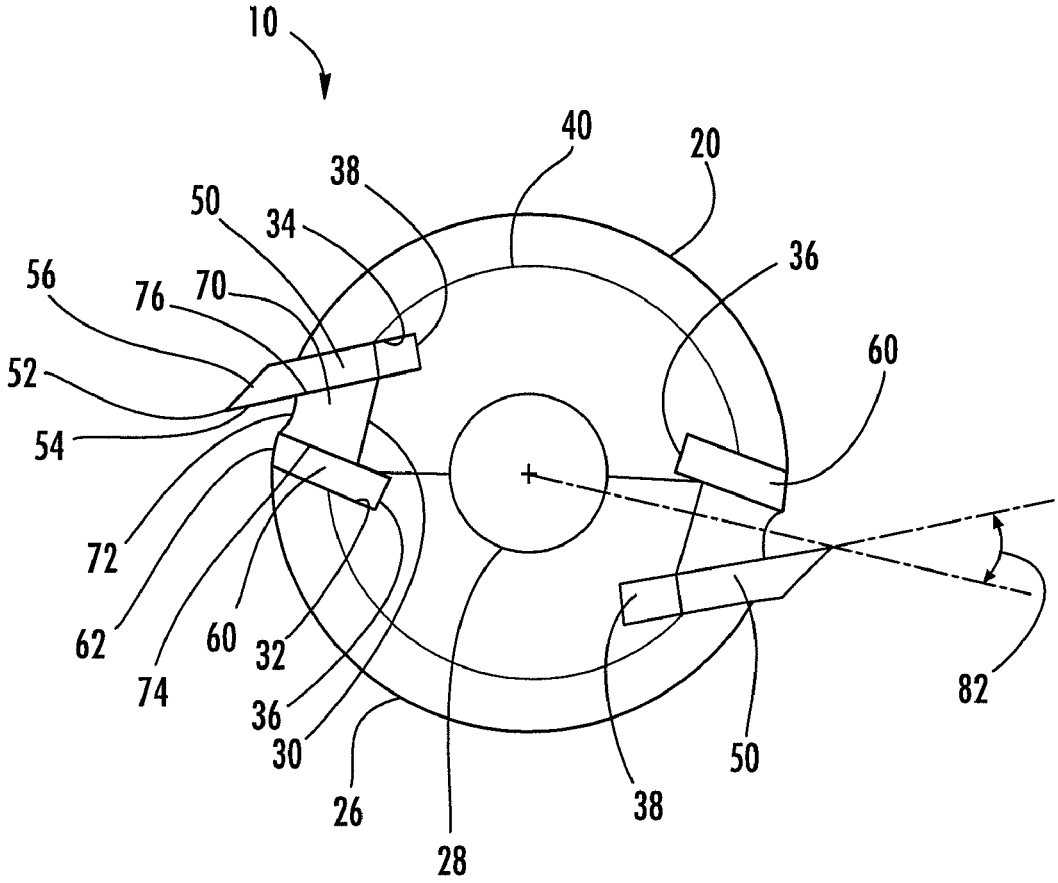
FIG. 4 is an elevation view of the cutting tool of FIG. 1 with the knives in a second configuration and shown without the visual references for clarity.

Each cavity 30 of the body 20 is adapted to receive and support one of the knives 50 in at least two configurations. Each cavity 30 includes a first pocket or slot 36 and a second pocket or slot 38. The cavity 30 is at least partially defined by a first knife support surface 32, which at least partially defines the first slot 36, and a second knife support surface 34, which at least partially defines the second slot 38. Thus, when one of the knives 50 is positioned in the first slot 36, as shown in FIG. 1, the knife 50 is proximate to and supported by, and preferably directly engaged by, the first knife support surface 32. Similarly, when one of the knives 50 is positioned in the second slot 38, as shown in FIG. 4, the knife 50 is proximate to and supported by, and preferably directly engaged by, the second knife support surface 34.

The cavities 30 of the body 20 are also adapted to receive the fillers 60. The fillers 60 may comprise any suitable stock material and preferably do not extend from the cavities 30. In the illustrated embodiments, each filler defines an angled surface 62, which may be flat or curved, for example, to match the curvature of the outer surface 26 of the body 20. Although the fillers 60 are shown to have the same thickness as the knives 50, the fillers 60 may have different thickness. In one embodiment, fillers 60 of different thicknesses are used according to the thickness of the knives 50, such that the total thickness of one knife 50 and one filler 60 is equal to a predetermined dimension. For example, a ¼ inch filler can be used with a ¼ inch knife, a 3/16 inch filler can be used with a 5/16 inch knife, and a ⅛ inch filler can be used with a ⅜ inch knife, so that the total thickness of the knife 50 and the filler 60 is ½ inch. Different predetermined dimensions and proportions are also within the scope of the present invention.

Each knife 50 and filler 60 is preferably frictionally secured in place in the respective cavity 30 by one of the gibs 70, each of which is positioned in each cavity 30 between the respective knife 50 and the filler 60. Each gib 70 defines first and second surfaces 74, 76 in an opposed configuration. As shown, for example, in FIGS. 1 and 4, the first and second surfaces 74, 76 of each gib 70 are directed toward the first and second knife support surfaces 32, 34, respectively. A curved surface 72 preferably extends between the surfaces 74, 76 to form a convex profile proximate to the knife 50. In the embodiments illustrated in FIGS. 1 and 4, the knives 50 are configured so that the first surface 54 of each knife 50 is the leading surface and is directed toward the gib 70. Thus, as each knife 50 processes the structural material and removes material, the curved surface 72 of the associated gib 70 tends to direct removed material away from the knife 50 and the tool 10.

Preferably the knives 50 and the fillers 60 can be positioned in the cavities 30 first and the gibs 70 can be positioned by positioning each gib 70 proximate to one of the sides 22, 24 of the body 20 and forceably sliding the gib 70 longitudinally into one of the cavities 30. Regardless of the order of assembly of the cutting tool 10, the knives 50, fillers 60, and gibs 70 preferably fit tightly in the cavities 30 so that a press fit is achieved and the gibs 70 urge the knives 50 and the fillers 60 respectively toward the knife support surfaces 32, 34 and thereby frictionally secure the knives 50 and the fillers 60 in the cavities 30. In one embodiment, bolts are not required for securing the knives 50, fillers 60, and gibs 70 in the cavities 30, but bolts can optionally be used to enhance securing, for example as discussed below with reference to FIGS. 6-7.

The knives 50, the fillers 60, the gibs 70, and/or the knife support surfaces 32, 34 can also be "corrugated," knurled, or otherwise contoured to facilitate the secure engagement of the knives 50, fillers 60, gibs 70, and body 20. Those of ordinary skill in the art will understand that in this context, corrugations include an alternating series of ridges and grooves that extend at least generally in the longitudinal direction, or the like. For example, in one embodiment shown in FIGS. 6 and 7, the second surface 56 of each knife 50, the knife support surfaces 32, 34, and the fillers 60 are corrugated such that the second surface 56 of each knife 50 and the filler 60 can be securely engaged to either of the knife support surfaces 32, 34.

Figure 6:
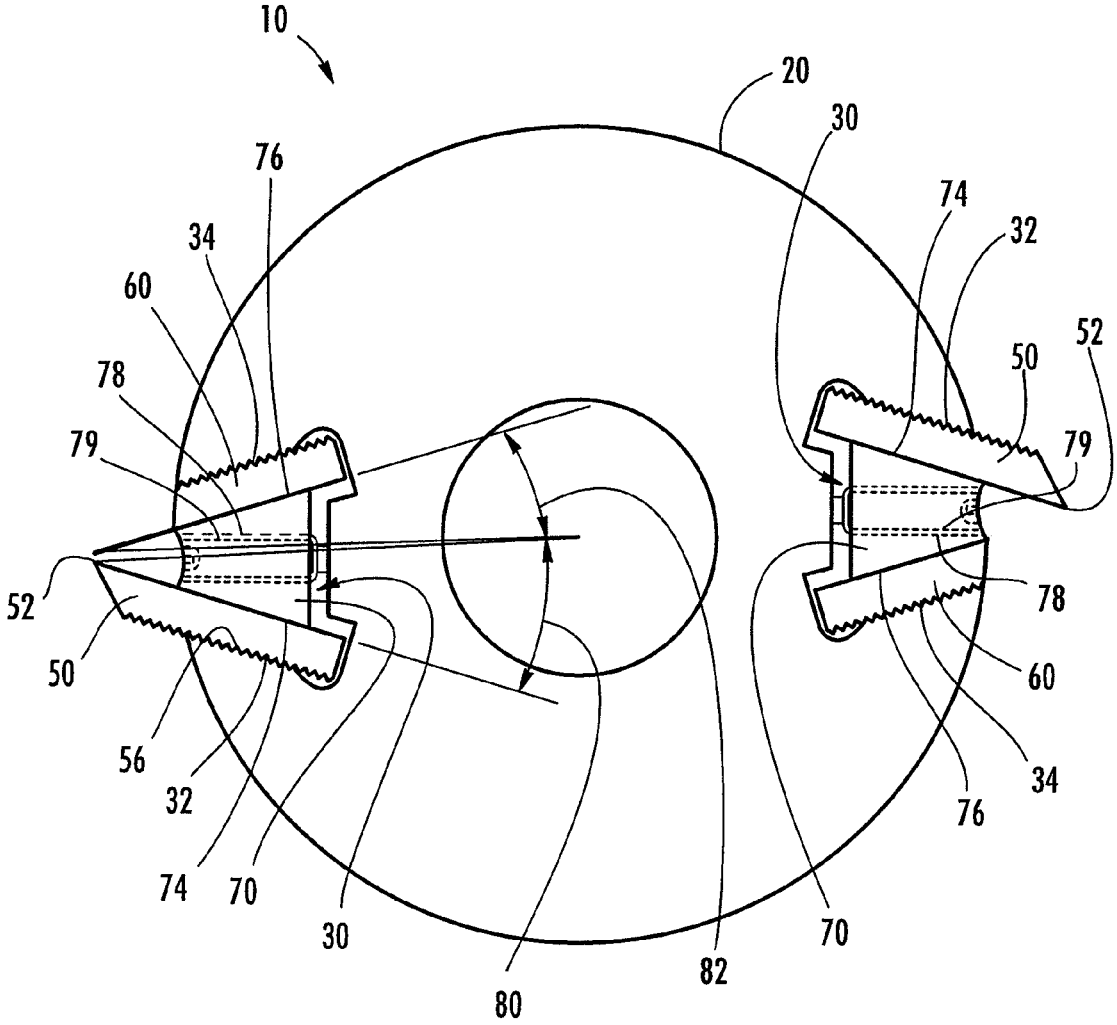
FIG. 6 is an elevation view of a cutting tool according to another embodiment of the present invention.
Figure 7:
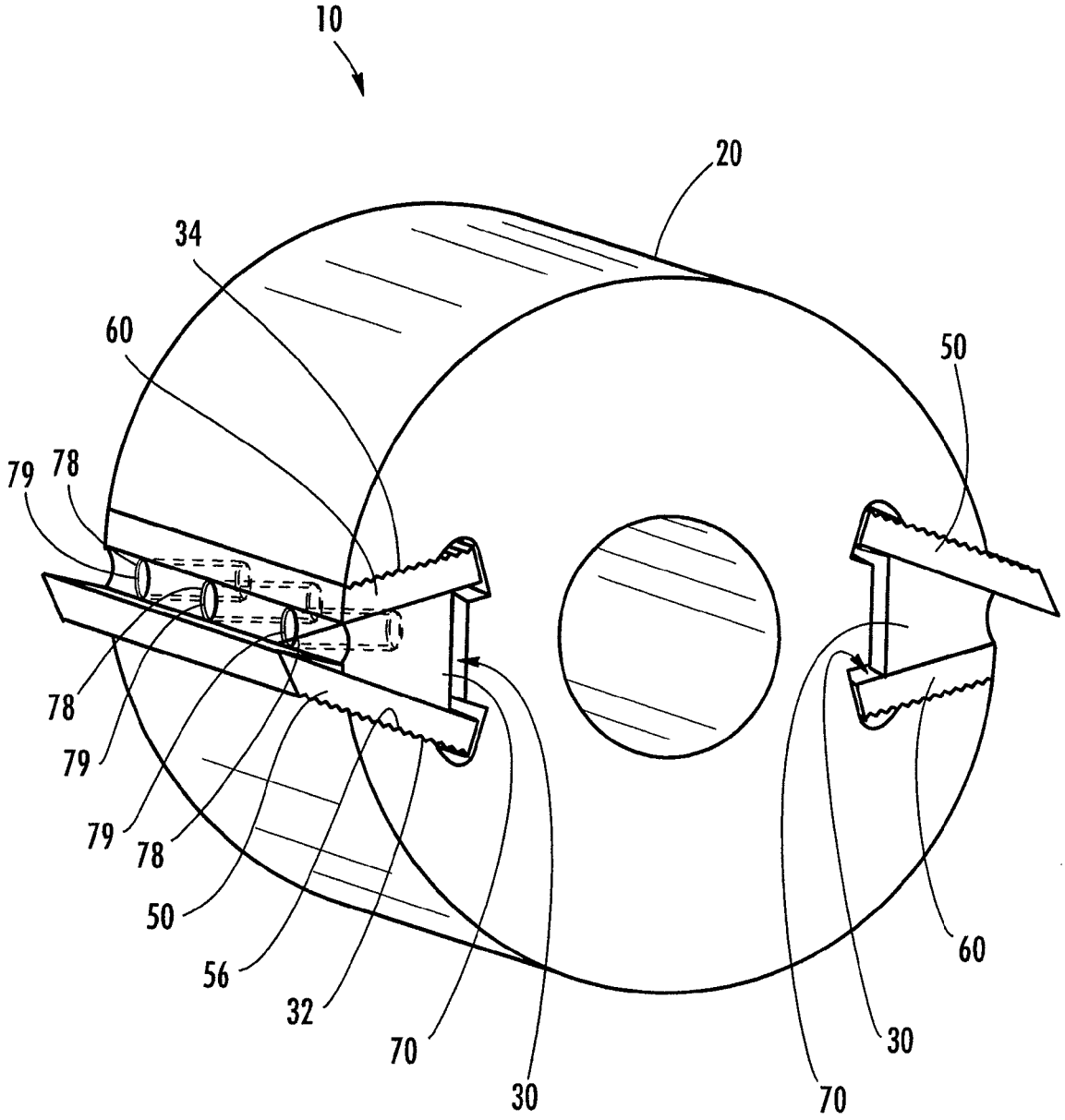
FIG. 7 is a perspective view of the cutting tool of FIG. 6.

Further, for the embodiment of FIGS. 6 and 7, each gib 70 defines one or more at least generally radially extending threaded bores 78 for receiving bolts 79 for securing the gib 70 against the respective knife 50 and filler 60. As shown, each bolt 79 can be inserted into the respective bore 78 and tightened to advance the bolt 79 so that the bolt 79 extends through the bore 78 and engages a wall defining the cavity 30. As the bolt 79 is further tightened and advanced through the bore 78, the bolt 79 adjusts the gib 70 outward from the cavity 30, thereby tightening the gib 70 against the knife 50 and filler 60. For purposes of illustration, the bores 78 and bolts 79 are shown in only one of the gibs 70 in FIG. 7, but the bores 78 and bolts 79 can similarly be provided in the other gib 70. Also, three bores 78 are shown in the gib 70 of FIG. 7, but any number of bores 78 and respective bolts 79 can be provided.

The first and second knife support surfaces 32, 34 are preferably angled differently relative to a radial direction of the body 20. For example, as shown in FIG. 1, the first knife support surface 32 is angled such that a first surface 54 of the knife 50 supported by the surface 32 forms a first hook angle 80 relative to a radial direction of the body 20 passing through a cutting edge 52 of the knife 50. As shown in FIG. 4, the second knife support surface 34 is angled such that the first surface 54 of the knife 50 supported by the second surface 34 forms a second hook angle 82 relative to a radial direction of the body 20 passing through the edge 52 of the knife 50. Preferably, there is a difference between the hook angles 80 and 82, such as a difference of at least about four degrees. The knives 50 can be configured at the first hook angle 80 as shown in FIG. 1 or at the second hook angle 82 as shown in FIG. 4 by switching the positions of the knives 50 and fillers 60.

In one preferred embodiment, the first knife support surface 32 is angled radially outwardly toward the second knife support surface 34, and the second knife support surface 34 is angled radially outwardly toward the first knife support surface 32, such that the first and second knife support surfaces 32, 34 define a converging angle therebetween, for example, as shown in FIG. 6. Preferably the angling is selected such that while the cutting tool 10 is operated as illustrated in FIG. 5, resulting centrifugal forces advantageously further secure the knives 50, fillers 60, and gibs 70 in their respective cavities, so that, for example, the magnitude of the initial press-fitting of these components can be reduced. In one preferred embodiment, one of the first and second hook angles 80, 82 is about 12° and the other of the hook angles 80, 82 is about 20°. For example, when the knife 50 is disposed against the first knife support surface 32 as shown in FIG. 6, the knife 50 defines the first hook angle 80, which is equal to about 20° in this embodiment, relative to a line extending from the edge 52 of the knife 50 to a longitudinal axis at the center of the body 20. Alternatively, when the knife 50 is disposed against the second knife support surface 34, the knife 50 defines the second hook angle 82, which is equal to about 12° in this embodiment, relative to a line extending from the edge 52 of the knife 50 to a longitudinal axis at the center of the body 20. A visual reference can be provided on the cutting tool 10 for indicating the first and second hook angles 80, 82. For example, textual angle indicators 42 can be stamped or otherwise disposed on the body 20, as shown in FIG. 1.

The knives 50 can preferably also be secured in different radial positions in the cavities 30 to adjust the extension of the knives 50 from the body 20. Thus, a particular knife 50 can be adjusted to achieve different lengths of extension from the body 20 as may be desired for different operations. A visual reference is preferably provided on the cutting tool 10 for indicating the maximum extension position of the knives 50. For example, the body 20 of the illustrated embodiments defines a maximum extension line 40 that marks the maximum extension position for the knives 50, i.e., the knives should not be extended beyond the line 40. For illustration, the knives 50 are shown in FIG. 4 in their maximum extension position, such that the innermost portions of the slots 38 are empty. Alternatively, the knives 50 are shown in approximately the minimum extension position in FIGS. 6 and 7, such that the knife 50, which is about 1.75 inches in one embodiment, extends about 0.5 inches from the body 20. The maximum extension line 40, and all of the other visual references mentioned herein, can each be used on cutting tools other than the cutting tool 10, such as on conventional cutting tools, where applicable.

The axial orientation of the knives 50 can be reversed. For example, in FIG. 1 the knives 50 are configured so that when the cutting tool 10 is rotated clockwise, the first surface 54 of each knife 50 is the leading surface, i.e., the first surface 54 is directed generally toward the tangential direction of motion of the knife 50, and a second surface 56 of each knife 50 is the trailing surface. In FIG. 4, the axial orientation of the knives 50 is reversed relative to FIG. 1 so that the first surface 54 leads when the cutting tool 10 is rotated counterclockwise. Preferably, each of the knives 50 is positioned in the body 20 and the cutting tool 10 is rotated so that the second surface 56 is supported by one of the knife support surfaces 32, 34, and the first surface 54 is the leading surface. In other embodiments, however, the first and second surfaces 54, 56 of the knives 50 are optionally reversed so that the first surfaces 54 are supported by one of the knife support surfaces 32, 34. Also, the rotational direction of motion of the cutting tool 10 can optionally be reversed relative to what is discussed above. Thus, either the first or second surfaces 54, 56 of the knives 50 can be the leading surfaces, although preferably the first surfaces 54 lead.

As noted above in connection with FIG. 2A, each of the cavities 30 of the body 20 of the cutting tool 10 can be disposed at a shear angle relative to the longitudinal axis of the body 20. Thus, as illustrated in FIGS. 1 and 2A, each cavity 30 can define multiple support surfaces 32, 34 disposed at different hook angles, and each of which is disposed at a shear angle. In this way, the shear angle and/or the hook angle for each knife 50 can be adjusted by selectively positioning the knives 50 in the cavities 30.

Figure 9:
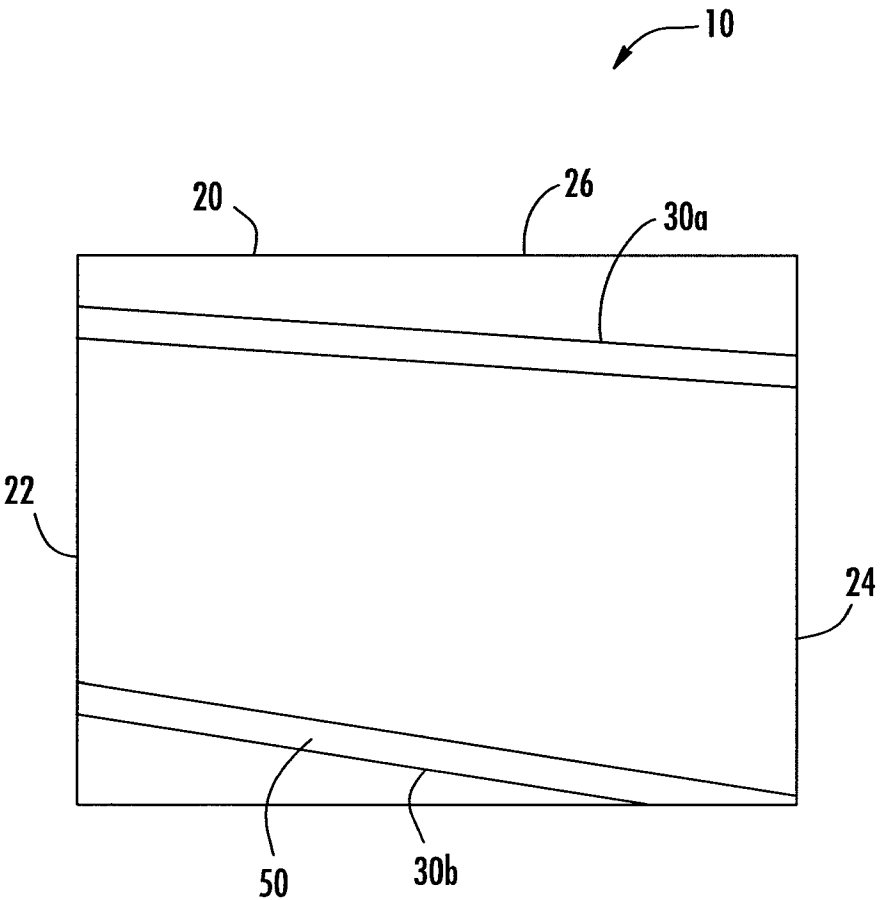
FIG. 9 is a side view of the cutting tool of FIG. 8.
Figure 8:
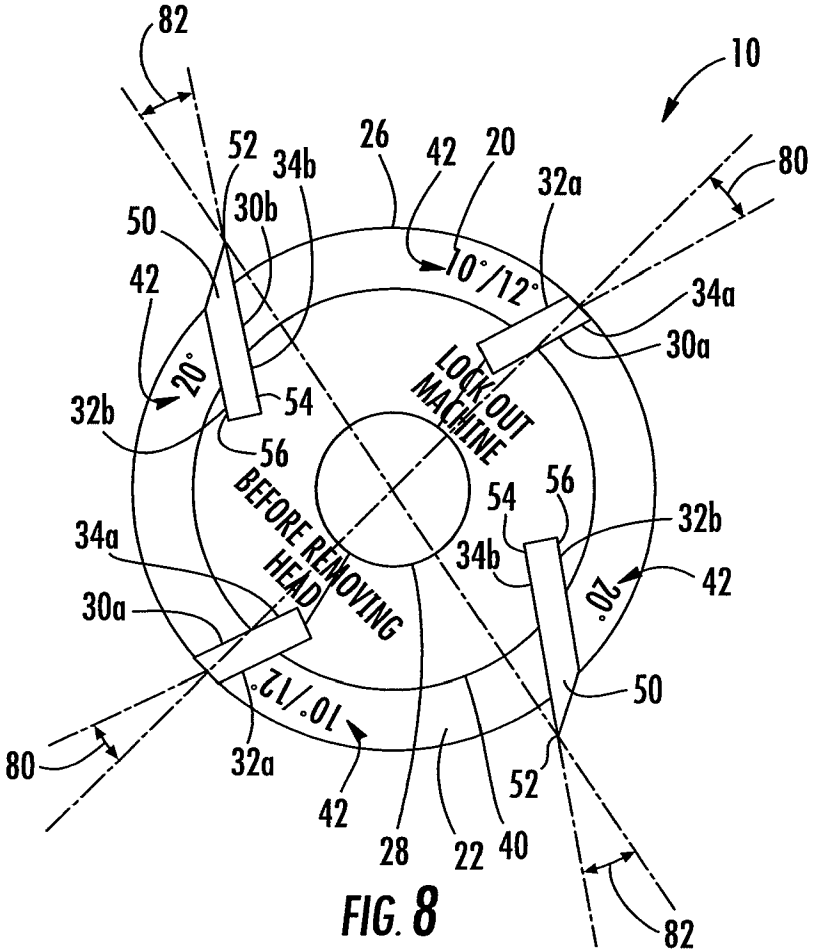
FIG. 8 is an elevation view of a cutting tool having cavities at different hook and shear angles according to another embodiment of the present invention.
Figure 11:
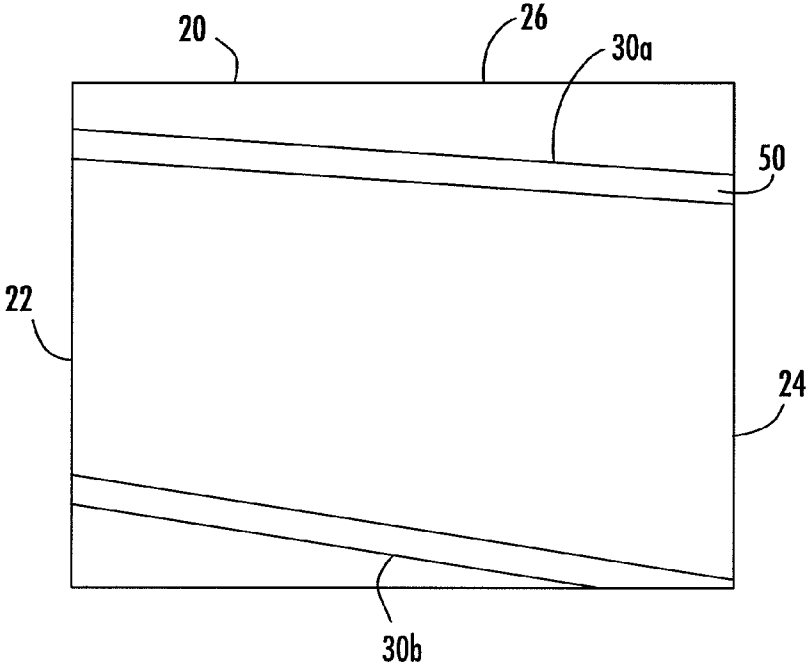
FIG. 11 is a side view of the cutting tool of FIG. 10.
Figure 10:
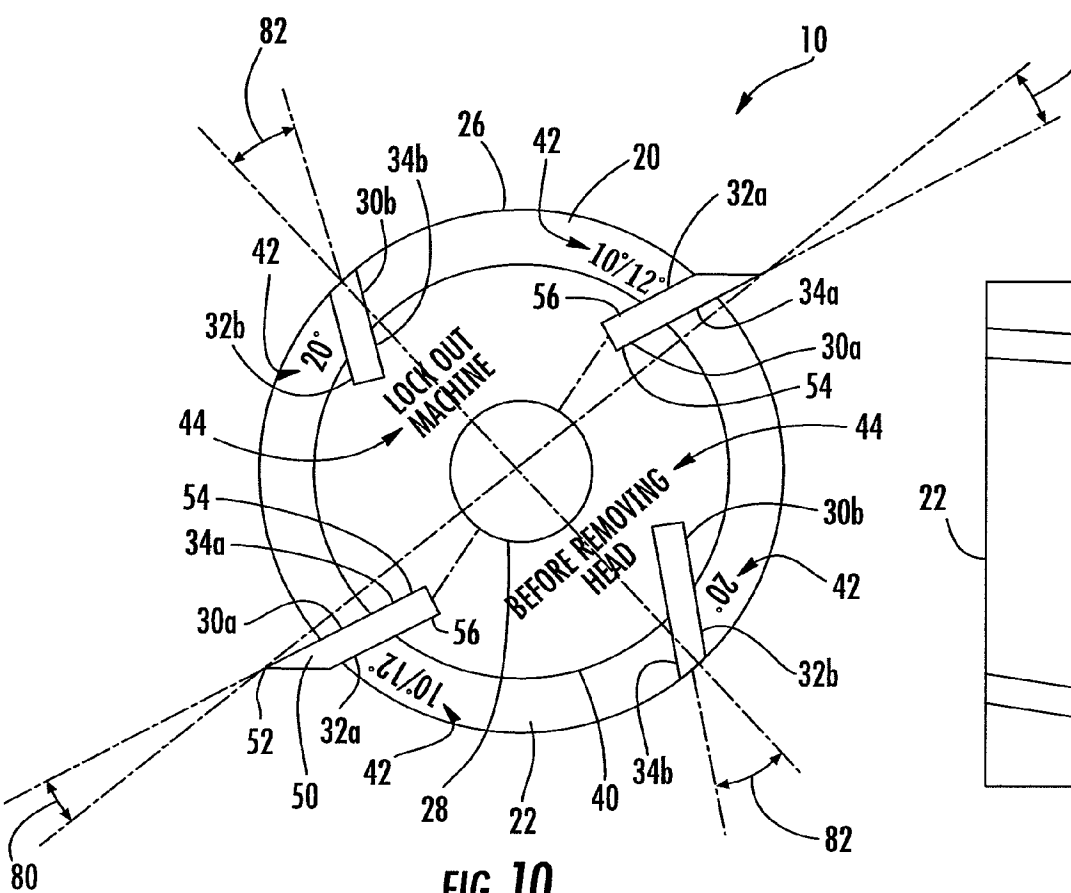
FIG. 10 is an elevation view of the cutting tool of FIG. 8 in another configuration, with the knives alternately disposed in other cavities of the body.

FIGS. 8-11 illustrate another cutting tool 10 having four cavities 30*a*, 30*b*. Each cavity 30*a*, 30*b* of the tool 10 shown in FIG. 8 is configured to support one knife 50 in a single configuration between support surfaces 32*a*, 34*a*, 32*b*, 34*b*; however, in other embodiments of the present invention, each cavity 30*a*, 30*b* can be configured to support one of the knives 50 in multiple alternate configurations. For example, as described above in connection with FIG. 1, each cavity can define support surfaces at different hook angles, such that each cavity can be configured to receive one of the knives and one or more filler, jib, or the like. As shown in FIGS. 8-11, two of the cavities 30*b* of the tool 10 are structured to support the knives 50 at a first hook angle, and the other two cavities 30*a* are structured to support the knives 50 at a second hook angle. In this case, the first hook angle can be about 20 degrees, and the second hook angle can be about 10 or 12 degrees, as indicated on the body 20 of the cutting tool 10 and illustrated in FIG. 8. In addition, the two cavities 30*b* are structured to support the knives 50 at a first shear angle, and the other two cavities 30*a* are structured to support the knives 50 at a second shear angle, as shown in FIG. 9. More particularly, the first shear angle is about 10 degrees and the second shear angle is about 5 degrees.

Thus, the cutting tool 10 shown in FIGS. 8-11 can be used in two configurations. In one configuration, shown in FIGS. 8 and 9, the knives 50 are disposed in the cavities 30*b* at a hook angle of about 20 degrees and a shear angle of about 10 degrees. In a second configuration, shown in FIGS. 10 and 11, the same or different knives are disposed in the cavities 30*a* at a hook angle of about 10 or 12 degrees and a shear angle of about 5 degrees. The two configurations, which can be provided with the same cutting tool 10, can be selectively achieved according to the operation to be performed with the cutting tool 10. For example, the first configuration can be used to process soft woods, and the second configuration can be used to process hard woods. It is appreciated that a variety of other configurations are possible, e.g., by modifying the hook and/or shear angles defined by the support surfaces 32*a*, 34*a*, 32*b*, 34*b* of the cavities 30*a*, 30*b*, the number of cavities 30*a*, 30*b*, the number of support surfaces 32*a*, 34*a*, 32*b*, 34*b* defined by each cavity 30*a*, 30*b*, the number and type of knives 50 that are used, and the like.

The knives 50 can define a variety of shapes and sizes, and preferably the knives used according to the present invention are conventional. For example, each knife can define a prismatic shape as illustrated in the figures, i.e., each knife can be uniform in the longitudinal (i.e., axial) direction. Alternatively, the edge 52 can define a non-linear profile to impart a corresponding profile onto the structural material. For example, the edge 52 can define one or more notches, curves, slants, and the like, which impart a corresponding profile on the structural material. Also, the knives 50 can be adjusted or maintained by machining or otherwise processing the surfaces 54, 56 to affect the cutting action of the knives 50. For example, in the illustrated embodiment, the second surface 56 of each knife 50 defines a tapered portion, which can be machined in order to sharpen the edge 52, change the angle of the tapered portion, or smooth the second surface 56.

The cutting tool 10 can optionally include one or more visual references that indicate the rotational motion of the tool 10. For example, the cutting tool of FIG. 1 includes rotational indicators 44 in the form of textual markings on the body 20 of the tool 10. The rotational indicators 44 can include words, numbers, other text, or non-textual marks, which can be stamped, ground, painted, inked, dyed, chemically-applied, or otherwise disposed on or in the tool 10. An operator viewing the cutting tool 10 can quickly and easily determine if the tool 10 is rotating by noting the appearance of the rotational indicators 44. Although shown only on the body 10 in FIG. 1, the rotational indicators may also be located on the other parts of the tool 10, such as the knives 50, fillers 60, or gibs 70. The rotational indicators may also provide information, such as specification or performance data regarding the cutting tool 10, safety instructions or warnings, or other user information. In one embodiment, the rotational indicators 44 comprise several first- and second-colored portions. First and second colors are disposed in the first- and second-colored portions, respectively, and the colors are positioned so that they alternate sequentially in a given spatial position as the cutting tool 10 rotates. Thus, as the cutting tool 10 rotates, an operator viewing the spatial position occupied by the colors will alternately see the first and second colors. To the human eye, colors that alternate at a sufficient frequency appear to blend to form a different color referred to as an "apparent" color, which can serve as a visual warning, as described in U.S. application Ser. No. 10/106,594, which is herein incorporated by reference in its entirety.

The tool 10 can be used with a wide variety of conventional knives 50, such as either corrugated or non-corrugated steel, carbide, stellite, or any other tool material.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A rotatable cutting tool for supporting at least one knife in at least two alternate cuffing configurations, the cutting tool comprising:

a body defining first and second cavities extending generally in a longitudinal direction of the body, the cavities being defined at least partly by knife support surfaces defining different hook angles relative to the radial direction of the body such that the first cavity is configured to support the knife at a first hook angle and the second cavity is configured to support the knife at a second hook angle different from the first hook angle, wherein each cavity extends in a direction that is nonparallel to the longitudinal axis of the body, such that each cavity is configured to support the knife at a shear angle relative to the longitudinal axis.

2. A rotating cuffing tool according to claim 1, wherein the first cavity defines a first shear angle relative to the longitudinal axis and the second cavity defines a second shear angle relative to the longitudinal axis, the first and second shear angles being different and thereby configured to alternately support the knife at the first and second shear angles.

3. A rotating cuffing tool according to claim 2, wherein each of the cavities defines a shear angle between about 0 and 10 degrees.

4. A rotating cuffing tool according to claim 2, wherein the first cavity defines the first shear angle being about 5 degrees and the second cavity defines the second shear angle being about 10 degrees.

5. A rotating cuffing tool according to claim 4, wherein the first cavity defines the first hook angle being between about 10 and 12 degrees and the second cavity defines the second hook angle being about 20 degrees.

6. A rotating cuffing tool according to claim 2, wherein the body defines third and fourth cavities extending generally in the longitudinal direction of the body for alternately supporting a second knife in alternate cuffing configurations, the third cavity being disposed at the first shear angle relative to the longitudinal axis and the fourth cavity being disposed at the second shear angle relative to the longitudinal axis, such that the body is configured to alternately support at least two knives at the first shear angle and at least two knives at the second shear angle.

7. A rotatable cutting tool according to claim 1, wherein the body defines a hole for receiving and connecting to a spindle configured to rotate the body.

8. A rotatable cutting tool according to claim 1, wherein each cavity is configured to receive the knife and at least one of a filler and a gib, such that the knife is urged against the support surface defining the cavity and thereby frictionally secured in the cavity.

9. A rotating cutting tool according to claim 1, wherein each of the first and second cavities defines two knife support surfaces defining different hook angles relative to the radial direction of the body such that each cavity is configured to support the knife at different hook angles.

10. A method of cutting structural material, comprising:

providing a cutting tool body defining first and second cavities extending in a longitudinal direction of the body, the cavities being defined at least partly by knife support surfaces defining different hook angles relative to the radial direction of the body such that the first cavity is configured to support the knife at a first hook angle and the second cavity is configured to support the knife at a second hook angle different from the first hook angle, each cavity extending in a direction that is nonparallel to the longitudinal axis of the body, the first cavity defining a first shear angle relative to the longitudinal axis and the second cavity defining a second shear angle relative to the longitudinal axis;

positioning a knife in the first cavity such that the knife is supported at the first shear angle and extends from the body at the first hook angle;

mounting the cutting tool body on a rotatable spindle in rotational communication with a rotational actuator;

rotating the cutting tool and cutting structural material by engaging the structural material against the knife;

subsequent to said cutting step, removing the knife from the first cavity and positioning a knife in the second cavity such that the knife is supported at the second shear angle and extends from the body at the second hook angle; and thereafter, repeating said rotating and cuffing step.

11. A method of claim 10, wherein said positioning steps comprise positioning the knife at different shear angles.

12. A method of claim 11, wherein each positioning step comprises positioning the knife at a shear angle between about 0 and 10 degrees.

13. A method of claim 11, wherein said first positioning step comprises positioning the knife at the first shear angle being about 5 degrees and the second positioning step comprises positioning the knife at the second shear angle being about 10 degrees.

14. A method of claim 13, wherein said first positioning step comprises positioning the knife at the first hook angle being between about 10 and 12 degrees and said second positioning step comprises positioning the knife at the second hook angle being about 20 degrees.

15. A method of claim 10, wherein said first positioning step further comprises positioning a knife in a third cavity of the body and said second positioning step further comprises positioning a knife in a fourth cavity of the body, the third and fourth cavities extending generally in the longitudinal direction of the body, the third cavity being disposed at the first shear angle relative to the longitudinal axis and the fourth cavity being disposed at the second shear angle relative to the longitudinal axis, such that the body is configured to alternately support at least two knives at the first shear angle and at least two knives at the second shear angle.

16. A method of claim 10, wherein each positioning step comprises inserting at least one of a filler and a gib in a respective one of the cavities with the knife to thereby urge the knife against the support surface defining the respective cavity and frictionally secure the knife in the respective cavity.

17. A method of alternately mounting cutting instruments in at least two cavities of a cutting tool and thereby selectively achieving alternate first and second configurations of the cutting tool according to processing operations to be performed with the cutting tool, comprising:

establishing a first cutting angle and thereby providing the cutting tool in the first configuration for a first cutting operation by forcibly securing a cutting instrument against a first surface within a first cavity of the cutting tool such that the cutting instrument extends from the first cavity at a first hook angle and at a first shear angle relative to a longitudinal direction of the cutting tool according to the orientation of the first surface; and subsequently establishing a second cutting angle that is substantially different from the first cutting angle and thereby providing the cutting tool in the second configuration for a second cutting operation by forcibly securing a cutting instrument against a second surface within a second cavity of the cutting tool such that the cutting instrument extends from the second cavity at a second hook angle and at a second shear angle relative to the longitudinal direction of the cutting tool according to the orientation of the second surface, wherein the orientations of the first and second surfaces are substantially different such that the first and second cutting angles are substantially different, wherein, with the cutting tool in the first configuration for the first cutting operation using the first cutting angle, no cutting instruments are provided in the second cavity for cutting, and, with the cutting tool in the second configuration for the second cutting operation using the second cutting angle, no cutting instruments are provided in the first cavity for cutting, such that different configurations are selectively provided.

18. A method of claim 17, wherein said first establishing step further comprises securing a cutting instrument in a third cavity of the body and said second establishing step further comprises securing a cutting instrument in a fourth cavity of the body, the third and fourth cavities extending generally in the longitudinal direction of the body, the third cavity being disposed at the first shear angle relative to the longitudinal axis and the fourth cavity being disposed at the second shear angle relative to the longitudinal axis, such that the body is configured to alternately support at least two cutting instruments at the first shear angle and at least two cutting instruments at the second shear angle.

19. A method of claim 18, wherein said first establishing step comprises securing the cutting instrument in the third cavity at the first hook angle and said second establishing step comprises securing the cutting instrument in the fourth cavity at the second hook angle.

20. A method of claim 17, wherein said first establishing step comprises securing the cutting instrument a hook angle between about 10 and 12 degrees and a shear angle of about 5 degrees, and said second establishing step comprises securing the cutting instrument a hook angle of about 20 degrees and a shear angle of about 10 degrees.

21. A rotatable cutting tool according to claim 1, wherein each of the knife support surfaces is contoured.

22. A rotatable cutting tool according to claim 1, wherein each of the knife support surfaces is corrugated.

23. A rotatable cutting tool according to claim 9, wherein each of the knife support surfaces is contoured.

24. A rotatable cutting tool according to claim 9, wherein each of the knife support surfaces is corrugated.

25. A method of claim 10, wherein each positioning step comprises positioning the knife against corrugations defined by the knife support surface.

26. A method of claim 25, wherein each positioning step comprises positioning a corrugated surface of the knife against the corrugations defined by the knife support surface.

27. A method of claim 17, wherein each establishing step comprises positioning the cutting instrument against corrugations defined by the cutting tool.

28. A method of claim 27, wherein each establishing step comprises positioning a corrugated surface of the cutting instrument against the corrugations defined by the cutting tool.

29. A rotatable cutting tool for supporting at least two knives in a cutting configuration, the cutting tool comprising:

a body defining first and second cavities extending generally in a longitudinal direction of the body, the cavities being defined at least partly by knife support surfaces, each knife support surface defining a hook angle relative to the radial direction of the body such that each cavity is configured to support a respective one of the knives at a predetermined hook angle, wherein each of the knife support surfaces is corrugated to thereby engage the respective knife; and a filler and a gib disposed in each of the cavities, such that each cavity is configured to receive one of the knives between the support surface of the cavity and the gib disposed in the cavity, the filler defining a corrugated surface configured to engage the body.

30. A rotatable cutting tool according to claim 29, wherein each cavity extends in a direction that is nonparallel to the longitudinal axis of the body, such that each cavity is configured to support the knife at a shear angle relative to the longitudinal axis.

31. A rotatable cutting tool according to claim 29, further comprising a knife disposed in each cavity, each knife defining a corrugated surface engaged to a respective one of the support surfaces.

32. A rotatable cutting tool according to claim 29, wherein each knife support surface defines a plurality of alternating ridges and grooves extending generally in the longitudinal direction of the body.

33. A method of claim 17, wherein said first and second establishing steps comprise securing the cuffing instruments at different hook angles relative to the radial direction of the body.

34. A method of claim 17, wherein said first and second establishing steps comprise securing the cuffing instruments at different shear angles relative to the longitudinal direction of the body.

* * * * *

UNITED STATES PATENT AND TRADEMARK OFFICE

CERTIFICATE OF CORRECTION

PATENT NO. : 7,237,586 B2
APPLICATION NO. : 11/047395
DATED : July 3, 2007
INVENTOR(S) : Rankin, Sr.

It is certified that error appears in the above-identified patent and that said Letters Patent is hereby corrected as shown below:

Column 9,
Lines 52 and 66, “cuffing” should read --cutting--.

Column 10,
Line 5, claim 3, “cuffing” should read --cutting--.
Line 8, claim 4, “cuffing” should read --cutting--.
Line 12, claim 5, “cuffing” should read --cutting--.
Line 16, claim 6, “cuffing” should read --cutting--.
Line 19, claim 6, “cuffing” should read --cutting--.
Line 65, claim 10, “cuffing” should read --cutting--.

Column 14,
Line 4, claim 33, “cuffing” should read --cutting--.
Line 8, claim 34, “cuffing” should read --cutting--.

Signed and Sealed this

Sixth Day of November, 2007

JON W. DUDAS
*Director of the United States Patent and Trademark Office*